US006978798B2

(12) United States Patent
Baarda

(10) Patent No.: US 6,978,798 B2
(45) Date of Patent: Dec. 27, 2005

(54) GAS FLOW CONTROL

(75) Inventor: Gerrit Jan Baarda, Emmen (NL)

(73) Assignee: Honeywell International, Inc., Morristown, NJ (US)

( * ) Notice: Subject to any disclaimer, the term of this patent is extended or adjusted under 35 U.S.C. 154(b) by 201 days.

(21) Appl. No.: 10/622,066

(22) Filed: Jul. 17, 2003

(65) Prior Publication Data

US 2004/0065369 A1 Apr. 8, 2004

(30) Foreign Application Priority Data

Jul. 18, 2002 (DE) ..... 102 32 654

(51) Int. Cl.[7] ..... F23N 1/00
(52) U.S. Cl. ..... 137/495; 137/613; 251/45
(58) Field of Search ..... 137/495, 510, 137/613 I, 489, 489.3, 491; 251/44, 45

(56) References Cited

U.S. PATENT DOCUMENTS 2,417,994 A * 3/1947 Sheets ..... 251/45
3,537,475 A * 11/1970 Pottinger ..... 137/613
3,741,710 A 6/1973 Nelson ..... 431/90
4,744,336 A * 5/1988 Miller ..... 251/44
5,899,434 A * 5/1999 Nishimura ..... 251/45

FOREIGN PATENT DOCUMENTS

| | | |
|---|---|---|
| DE | 21 11 343 | 4/1972 |
| DE | 198 21 853 C1 | 7/1999 |
| DE | 100 18 757 A1 | 10/2001 |
| DE | 100 26 035 A1 | 12/2001 |
| EP | 0 379 759 B1 | 4/1995 |
| EP | 1 058 060 A1 | 12/2000 |

* cited by examiner

*Primary Examiner*—Stephen M. Hepperle

(57) ABSTRACT

An approach for gas flow control is achieved with an arrangement involving a sealed housing with relatively few components. According to an example embodiment, a gas flow controller comprises a gas inlet, a gas outlet, and an auxiliary chamber including a partition wall that separates it from the gas inlet. By means of a differential pressure between the inlet and the auxiliary chamber, a valve arrangement is actuated through a diaphragm provided on the partition wall to control a flow from the gas inlet to the gas outlet. A servo pump 2 is provided on the partition wall and produces the differential pressure by pumping the gas from the auxiliary chamber to the gas inlet.

11 Claims, 3 Drawing Sheets

GAS FLOW CONTROL

FIELD OF THE INVENTION

The present invention relates to gas flow control, and more particularly, to approaches for gas flow control involving differential pressure.

BACKGROUND

Controllers for gas burners are provided for controlling the gas supply to the gas burner and are arranged between a gas supply source and the gas burner. In many applications, diverse controllers for gas burners are known and include, e.g., a main valve, a differential pressure generating means and a corresponding controller. The controller serves for adjusting a gas output pressure to a desired value.

For adjusting a gas output pressure, a differential pressure is generated and adjusted between two channels. Between the channels, a valve is arranged whose valve member is prestressed in the closing direction by a prestressing means. A generated differential pressure allows an opening of the valve against the prestressing means so that a gas flow is made possible. By adjusting the differential pressure between the first channel and the second channel, additionally, the gas output pressure can be adjusted. In various applications, the differential pressure is generated, e.g., by a device that is connected to the respective pressure regions of the gas flow controller via external conduits. Such external connection, however, can present challenges to the implementation of gas flow control and to the efficient and concise arrangement of devices for effecting the control.

SUMMARY

The present invention is directed to an approach for gas flow control that addresses challenges including those discussed above.

According to an example embodiment of the present invention, gas flow between an inlet and an outlet is controlled using a valve arrangement actuated as a function of differential pressure between an auxiliary chamber and the inlet. The differential pressure is controlled using a pump arrangement adapted to pump gas between the auxiliary chamber and the inlet.

In one implementation, the inlet and outlet are part of a pressure-containing housing, with the auxiliary chamber being in the housing and separated from the inlet by a diaphragm. The pump is located in the housing and produces differential pressure by pumping gas from the auxiliary chamber to the inlet, thus creating a relatively higher pressure at the inlet. The differential pressure exerts force on the diaphragm that, in response to the differential pressure, actuates the valve arrangement to control flow between the inlet and outlet.

BRIEF DESCRIPTION OF THE FIGURES

In the following, the invention will be described more precisely by referring to example embodiments in combination with the attached drawings wherein.

DETAILED DESCRIPTION

Figure 1:
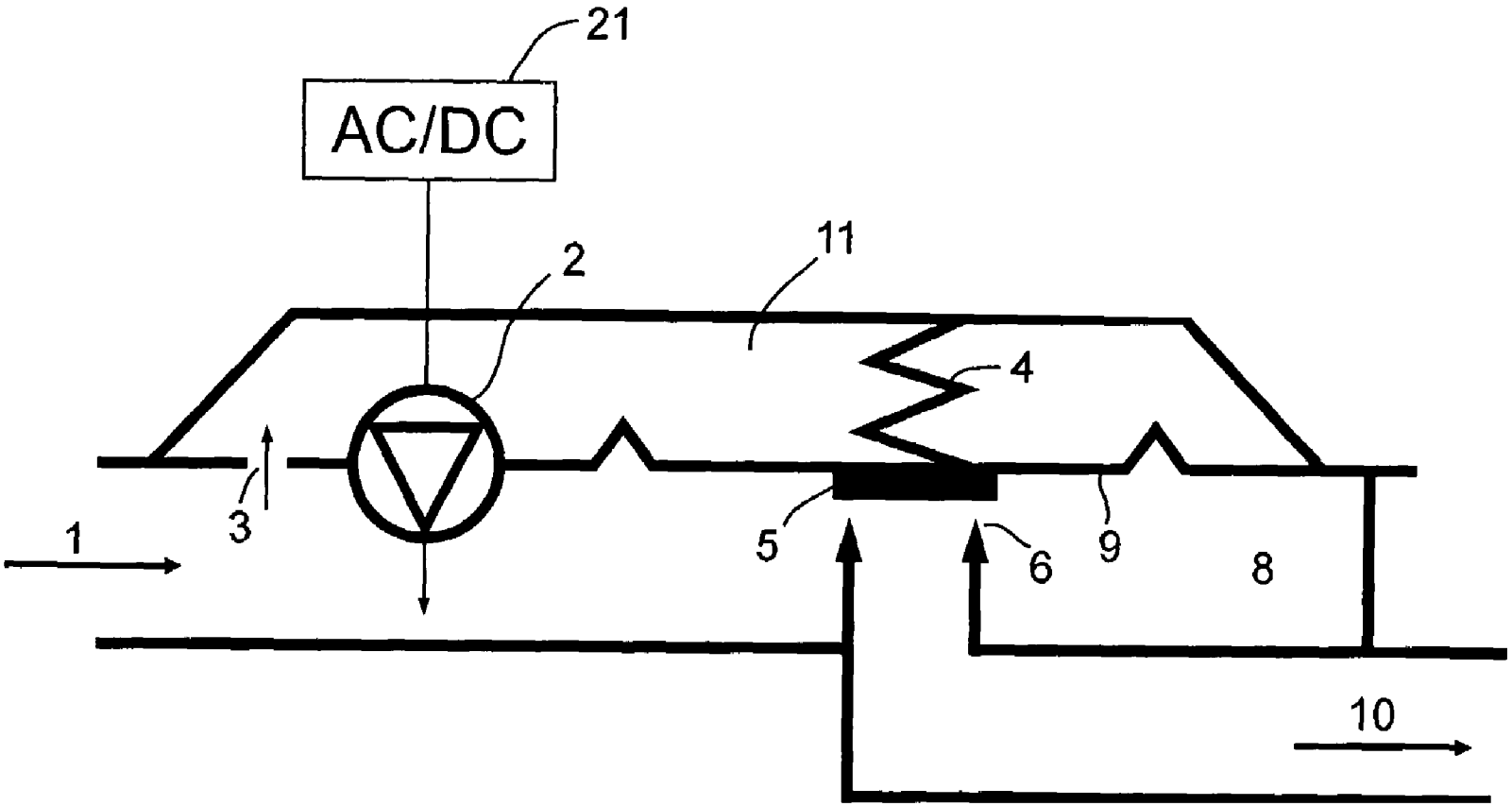
FIG. 1 shows a first embodiment of a gas controller implemented for controlling gas burners according to an example embodiment of the present invention.

In the following description, reference is made to the accompanying drawings that form a part hereof, and in which is shown by way of illustration particular embodiments in which the invention may be practiced. It is to be understood that other embodiments may be utilized, as structural and operational changes may be made without departing from the scope of the present invention.

According to an example embodiment of the present invention, a gas flow controller has a gas inlet and a gas outlet provided at a pressure-containing housing in which an intermediate chamber is separated from the gas inlet by a diaphragm, wherein, by means of a differential pressure between the inlet and the auxiliary chamber, a valve arrangement can be actuated to control a flow from the gas inlet to the gas outlet. According to this gas flow controller, a servo pump producing the differential pressure by pumping the gas from the auxiliary chamber to the gas inlet is provided in the housing. In one implementation, the servo pump of the gas flow controller is arranged on a partition wall that separates the auxiliary chamber from the gas inlet's channel.

The pump is arranged within the controller and between adjacent areas of differential pressure. For this reason, it is possible to avoid tube joints and, in particular, cuttings through walls of the pressure-containing elements of the controller between the servo pump and the corresponding areas. Thus, a controller having a good response characteristic and an increased inherent security is created since fewer components are provided.

According to another example embodiment of the invention, the gas flow controller comprises an overflow device forming a permanent fluid connection between the auxiliary chamber and the channel of the inlet, said overflow device having several functions. On the one hand, it allows that there is pressure at the gas inlet in the auxiliary chamber when, e.g., the servo pump is not in operation. This enables the pressure to act upon the diaphragm's backside so that the valve member is pressed onto the valve seat with increased force. On the other hand, the overflow device has a throttling function during operation of the pump so that the pressure in the auxiliary chamber can be reduced. With this approach, the overflow device contributes to the system's inherent security as, upon failure of the servo pump, the valve is closed.

According to another example embodiment of the invention, the overflow device includes at least one opening arranged on the partition wall that separates the auxiliary chamber from the channel of the gas inlet and/or of at least one channel provided on the servo pump. The opening may include, e.g., a hole in the partition wall and/or at the diaphragm. The position of the hole and/or the overflow device is freely selectable provided that a permanent fluid connection between the auxiliary chamber and the channel of the inlet is ensured. The overflow device can also be provided as a channel in the servo pump. If the valve arrangement includes more than one valve, the overflow device preferably includes a number of openings and/or channels corresponding to the number of valves.

According to another example embodiment of the invention, the valve arrangement includes at least two functionally separated valves, the valves being arranged serially with regard to the flow. This is especially effective for increasing the inherent security of the system and in particular of the passive valves. If a member of a valve fails the other valve can stop the flow of the gas while the servo pump is in a switched-off state. If for example a spring of a valve fails the valve member can no longer be self-actingly placed on the valve seat. In some implementations, more than two valves are provided. In other implementations, parameters of the valve arrangement such as the springs' stiffness and the effective surfaces of the diaphragms can be adjusted so that an advantageous response characteristic of the whole system can be achieved.

According to another example embodiment of the invention, the valve arrangement closes the connection between the gas inlet and the gas outlet when the differential pressure is less than a predetermined value. This produces the effect that, only upon operation of the servo pump, a flow is effected. In one implementation, the flow (pressure, rate of flow) is set by adjusting or controlling the servo pump. If the pump fails the valve arrangement is closed automatically so that the flow is stopped.

According to another example embodiment of the invention, the pressure in the auxiliary chamber presses the valve member onto the valve seat when the valve is closed. Thus, with the servo pump being in a switched off state, when the pressure in the auxiliary chamber and in the channel of the gas inlet is increased, the force is increased by which the diaphragm presses the valve member onto the valve seat. With this approach, an increased tightness is obtained while the pressure in the gas inlet is increased.

According to another example embodiment of the invention, a prestressing means for closing the connection at a valve member and/or the diaphragm is provided. The prestressing means can be designed, e.g., as a spring allows an automatic closing of the valve when the servo pump is in a switched-off state. With this approach, it increases the security of the whole system.

According to another example embodiment of the invention, the servo pump is an electrically driven pump. Electrical connections are provided in the area of the partition wall between the auxiliary chamber and the channel of the gas inlet. With this approach, an electrical pump is easily controllable.

FIG. 1 is a schematic representation of gas flow controller, according to another example embodiment of the present invention. The pressure controller in FIG. 1 is applicable, for example, for use in the control of gas supplied to gas burners. The gas flow controller comprises a gas inlet 1 and a gas outlet 10. In the passage between the gas inlet 1 and the gas outlet 10, a valve arrangement consisting of a valve member 5, a prestressing member 4 and a valve seat 6 are disposed. In a state without pressure, the prestressing member 4 (e.g., a spring) presses the valve member 5 towards the valve seat 6 and blocks the connection between the gas inlet 1 and the gas outlet 10. At the gas inlet 1, in the direction of flow, an auxiliary chamber 11 is provided. Between the auxiliary chamber 11 and the gas inlet 1, an overflow device 3 is provided, via which the gas inlet 1 is in permanent connection with the auxiliary chamber 11. According to this embodiment, the overflow device 3 is formed as a hole in a partition wall between the auxiliary chamber and the gas inlet.

According to the shown embodiment, the auxiliary chamber 11 is arranged at the channel which extends, in the direction of flow, from the gas inlet 1 to the valve. In particular, a diaphragm 9 is provided between the channel extending from the gas inlet 1 and the auxiliary chamber 11, the diaphragm 9 being disposed in the partition wall.

The valve member 5 is located in the direction of a valve seat 6 for closing same and disposed on one side of the diaphragm 9 which is placed in position with respect to the valve seat. This valve seat 6 leads into the channel of the gas outlet 10. In an unpressurized state of the system, the prestressing member 4 presses the diaphragm 9 and, thus, the valve member 5 onto the valve seat 6 and, in this way, blocks the connection between the gas inlet 1 and the gas outlet 10.

According to the invention, a servo pump 2 is provided in the pressure-containing housing. This servo pump 2 is disposed so as to be able to feed the fluid from the auxiliary chamber 11 to the channel of the gas inlet 1. In one instance, the servo pump 2 is an electrically operated pump. The electric power is supplied to the servo pump 2, e.g., via electric lines that are installed in one of the outer walls. The servo pump 2 can be arranged on the partition wall so that the servo pump 2 penetrates the partition wall.

In other implementations, the servo pump 2 is disposed in any place in the pressure-containing housing with conduits connecting the servo pump 2 with the auxiliary chamber 11 as well as with the channel of the gas inlet 1.

In an unpressurized state, the valve member 5 of the valve is pressed against the valve seat 6 by the force of the prestressing means 4. Thus, the passage between the gas inlet 1 and the gas outlet 11 is blocked. When a pressure applied to the gas inlet 1 is higher than the pressure in the gas outlet 10, the valve member 5 is pressed onto the valve seat 6 by the force which, in addition to the prestressing force of the prestressing means 4, results from the pressure applied to the diaphragm 9 in the auxiliary chamber. If the servo pump 2 is operated fluid and/or gas flows from the auxiliary chamber towards the gas inlet 1 and, through the overflow device 3, back into the auxiliary chamber 11. Due to the throttling effect of the overflow device 3, the pressure in the auxiliary chamber 11 is reduced with respect to the pressure in the gas inlet 1, thereby forming a differential pressure between the auxiliary chamber and the gas inlet. As the rate of flow of the servo pump 2 is adjustable also the differential pressure between the channel of the gas inlet 1 and the auxiliary chamber 11 can be adjusted. For example, the differential pressure can assume a value where, against the prestressing force of the spring 4, the valve member 5 is lifted from the valve seat 6 as soon as the sum of pressure forces acting upon the diaphragm 9 is more than the amount of the spring force of the spring 4.

When the valve member 5 is lifted from the valve seat 6 the passage between the gas inlet 1 and the gas outlet 11 is cleared and the gas can flow from the gas inlet 1 to the gas outlet 10.

By adjusting the rate of flow of the servo pump 2, the rate of flow is adjusted by the gas flow controller additionally in dependence on the pressures existing at the gas outlet 10 and the gas inlet 1. If the servo pump 2 is switched off, flow continues via the overflow device 3 and the differential pressure is reduced. The spring 4 presses the diaphragm 9 and, thus, the valve body 5 in the direction of the valve seat 6, thereby closing the passage between the gas inlet 1 and the gas outlet 10. If the servo pump is unintentionally switched off, fails or the supply of power is missing the valve is closed. This ensures a fail-safe operation where, upon malfunction of the servo pump 2, an unintentional continuation of the flow of gas and/or fluid is prevented.

According to one example embodiment of the invention, the pump is disposed in the gas flow controller. In particular, the servo pump is disposed on the member separating the auxiliary chamber 11 and the channel of the gas inlet 1.

Electric energy is supplied to the electrically operated servo pump 2 via lines laid in one of the walls of the gas flow controller. Consequently, no further gas lines are necessary to connect the servo pump 2 to the auxiliary chamber 11 and the channel of the gas inlet 1. This increases safety as a reduction of connections, conduits and the like results in a reduction of causes of damage.

In one implementation, the servo pump 2 is an electric pump, coupled to an electric source 21.

Figure 2:
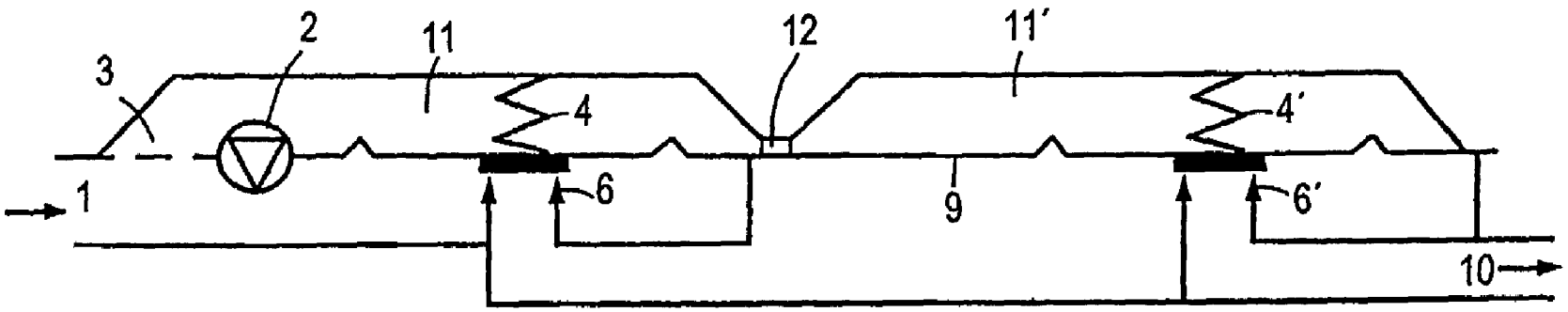
FIG. 2 shows a second embodiment of a gas controller implemented for controlling gas burners according to another example embodiment of the present invention.

FIG. 2 shows another gas flow controller for gas burners according to another example embodiment of the present invention. Various elements in FIG. 2 are similar to those shown and discussed above in connection with FIG. 1, with further discussion thereof omitted here for brevity.

A gas inlet 1 includes a channel, an auxiliary chamber 11 and a gas outlet 10 that are disposed likewise in a manner adjacent to each other. Between the auxiliary chamber 11 and the channel of the gas inlet 1, a partition wall is provided on which a servo pump 2 adapted to feed the fluid and/or gas from the auxiliary chamber 11 to the channel of the gas inlet 1 is disposed. In addition, a valve arrangement including a valve member 5, a spring 4 and a valve seat 6 is provided. However, the valve seat 6 does not lead directly into the gas outlet 10 but is connected to a second valve arrangement. The spring 4' of the second valve arrangement is disposed in a second auxiliary chamber 11' and located on one wall thereof. The second auxiliary chamber 11' is connected to the first auxiliary chamber 11 via an opening 12. The opening 12 between the first auxiliary chamber 11 and the second auxiliary chamber 11' can be designed so as to have a certain throttling effect. Thus, the response characteristic of the valve arrangement can be adjusted.

When the servo pump 2 is operated so that the differential pressure between the auxiliary chambers 11 and 11' as well as the channel of the inlet 1 is sufficient to lift the first valve member 5 from the first valve seat 6 and the second valve member 5' from the second valve seat 6', a flow of the gas from the gas inlet 1 to the gas outlet via the first valve seat 6 and second valve seat 6' is made possible.

With the approach shown in FIG. 2, the gas flow controller's safety is further increased as, upon failure of elements of one of the valve arrangements, the second valve arrangement is able to stop the flow of gas in a sufficiently reliable manner when the servo pump is in a switched-off state.

In one instance, the overflow device 3 of FIG. 2 includes at least two separate openings. This results in the effect that two valve systems structurally separated from each other are provided where one opening is provided for each of the valve systems. If one of the openings of the overflow device 3 is blocked up there is still a second opening that ensures the functioning of the whole system with only one servo pump 2.

In addition, the response characteristic of the entire gas flow controller including two valve arrangements can be influenced by adjusting parameters such as spring stiffness, diameter of the valve member and mass of the valve member, effective diaphragm surface etc.

According to a modified embodiment of the invention that essentially corresponds to FIGS. 1 and 2, the overflow device 3 is provided on the servo pump 2. Like in the first and second embodiment, according to the modified embodiment, the servo pump 2 is disposed on the partition wall separating the auxiliary chamber 11 from the gas inlet 1. According to this embodiment, a channel is provided in the servo pump 2 that connects the auxiliary chamber 11 to the channel of the gas inlet 1. If the overflow device 3 consists of more than one opening all of these openings can be provided in the servo pump 2. It is, however, also possible to provide plural openings on the servo pump 2 and the partition wall.

Figure 3:
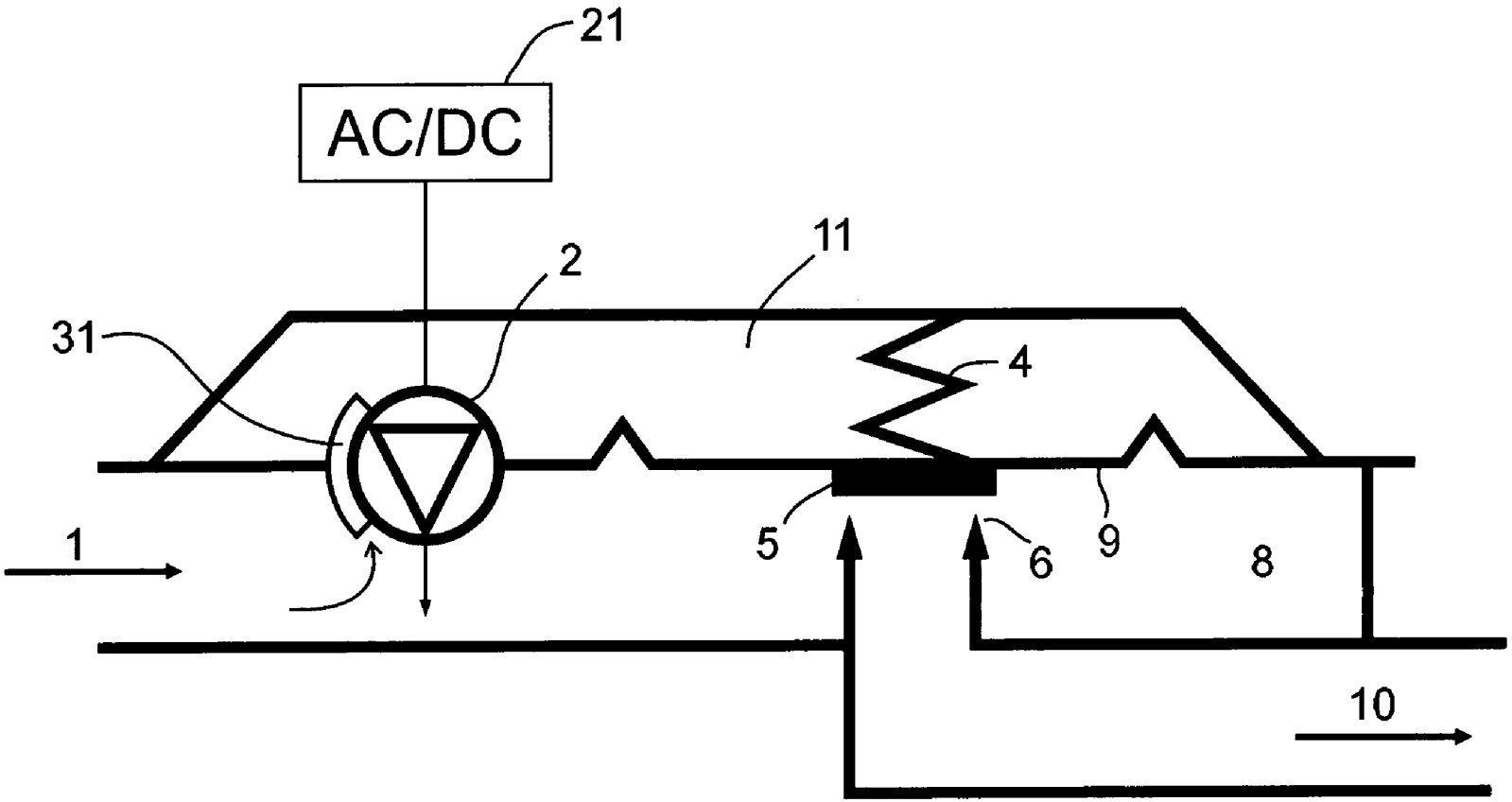
FIG. 3 shows a gas controller implemented for controlling gas burners, according to another example embodiment of the present invention.

FIG. 3 shows a gas controller arrangement similar to that shown in FIG. 1, according to another example embodiment of the present invention. Various portions of the gas controller arrangement in FIG. 3 correspond to, and are labeled consistently with, portions of FIG. 1, with the corresponding description thereof omitted here for brevity. Relative to FIG. 1, FIG. 3 shows the selective (optional) omission of the overflow device 3 of FIG. 1, with a channel 31 being in (e.g., a portion of) the servo pump 2.

The foregoing description of various embodiments of the invention has been presented for the purposes of illustration and description. It is not intended to be exhaustive or to limit the invention to the precise form disclosed. Many modifications and variations are possible in light of the above teaching. It is intended that the scope of the invention not be limited with this detailed description.

What is claimed is:

1. A gas flow controller comprising:

a pressure-containing housing including a gas inlet, a gas outlet, an auxiliary chamber separated from the gas inlet by a partition wall and a valve arrangement adapted to be actuated to adjust flow from the gas inlet to the gas outlet in response to a differential pressure between the inlet and the auxiliary chamber; and a servo pump in the housing and adapted to produce the differential pressure by pumping the gas from the auxiliary chamber to the gas inlet.

2. A gas flow controller according to claim 1, wherein the servo pump is disposed on the partition wall.

3. A gas flow controller according to claim 1, further comprising:

an overflow device that forms a permanent fluid connection between the auxiliary chamber and a channel at the inlet.

4. A gas flow controller according to claim 3, wherein the overflow device includes at least one of: an opening provided on the partition wall and a channel provided on the servo pump.

5. A gas flow controller according to claim 1, wherein the valve member is adapted to be actuated by a diaphragm adapted to actuate the valve member in response to the differential pressure between the gas inlet and the auxiliary chamber.

6. A gas flow controller according to claim 1, wherein the valve arrangement includes at least two functionally separated valves arranged serially with respect to the flow of the gas.

7. A gas flow controller according to claim 6, wherein the valve arrangement is disposed on the auxiliary chamber and the auxiliary chambers are in fluid connection via an opening.

8. A gas flow controller according to claim 1, wherein the valve arrangement closes the connection between the gas inlet and the gas outlet in response to the differential pressure being less than a predetermined value.

9. A gas flow controller according to claim 1, wherein the valve arrangement includes a valve member and a valve seat, the valve member configured and arranged to close the valve arrangement in response to pressure in the auxiliary chamber pressing the valve member onto the valve seat.

10. A gas flow controller according to claim 9, further comprising:

a prestressing means configured and arranged to apply pressure to the valve member for pressing the valve member onto the valve seat for closing the valve arrangement.

11. A gas flow controller according to claim 1, wherein the servo pump is an electrically operated pump.

* * * * *